US008376878B2

(12) United States Patent
Bennett et al.

(10) Patent No.: US 8,376,878 B2
(45) Date of Patent: Feb. 19, 2013

(54) GOLF CLUB HEAD HAVING VARIABLE CENTER OF GRAVITY LOCATION

(75) Inventors: Thomas O. Bennett, Carlsbad, CA (US); Doug Roberts, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 12/473,463

(22) Filed: May 28, 2009

(65) Prior Publication Data

US 2010/0304887 A1 Dec. 2, 2010

(51) Int. Cl.
*A63B 53/04* (2006.01)
*A63B 53/06* (2006.01)

(52) U.S. Cl. ..... 473/334; 473/335; 473/336; 473/338; 473/349; 473/350

(58) Field of Classification Search ..... 473/324–350, 473/287–291
See application file for complete search history.

(56) References Cited

U.S. PATENT DOCUMENTS

| | | | | | |
|---|---|---|---|---|---|
| 922,444 | A * | 5/1909 | Youds | 473/342 |
| 1,133,129 | A * | 3/1915 | Govan | 473/337 |
| 1,518,316 | A * | 12/1924 | Ellingham | 473/337 |
| 1,840,924 | A * | 1/1932 | Tucker | 473/337 |
| 2,163,091 | A * | 6/1939 | Held | 473/338 |
| 3,652,094 | A * | 3/1972 | Glover | 473/337 |
| 3,845,960 | A * | 11/1974 | Thompson | 473/336 |
| 3,979,122 | A * | 9/1976 | Belmont | 473/336 |
| 3,979,123 | A * | 9/1976 | Belmont | 473/337 |
| 4,076,254 | A * | 2/1978 | Nygren | 473/337 |
| 4,195,842 | A * | 4/1980 | Coleman | 473/337 |
| 4,206,924 | A * | 6/1980 | Koralik | 473/349 |
| 4,607,846 | A * | 8/1986 | Perkins | 473/336 |
| 4,962,932 | A * | 10/1990 | Anderson | 473/336 |
| 5,013,041 | A * | 5/1991 | Sun et al. | 473/252 |
| 5,050,879 | A * | 9/1991 | Sun et al. | 473/338 |
| 5,385,348 | A * | 1/1995 | Wargo | 473/338 |
| 5,489,097 | A * | 2/1996 | Simmons | 473/326 |
| 5,599,243 | A * | 2/1997 | Kobayashi | 473/335 |
| 5,688,189 | A * | 11/1997 | Bland | 473/314 |
| 6,077,171 | A * | 6/2000 | Yoneyama | 473/291 |
| 6,264,571 | B1 * | 7/2001 | Lekavich | 473/340 |
| 6,290,609 | B1 * | 9/2001 | Takeda | 473/335 |
| 6,485,375 | B1 * | 11/2002 | McKinley | 473/245 |
| 6,638,183 | B2 * | 10/2003 | Takeda | 473/335 |
| 6,923,734 | B2 * | 8/2005 | Meyer | 473/336 |
| 7,083,530 | B2 * | 8/2006 | Wahl et al. | 473/334 |
| 2002/0061788 | A1 * | 5/2002 | Marcase | 473/324 |
| 2003/0139226 | A1 * | 7/2003 | Cheng et al. | 473/334 |
| 2006/0172816 | A1 * | 8/2006 | Johnson | 473/334 |
| 2008/0020861 | A1 * | 1/2008 | Adams et al. | 473/334 |

* cited by examiner

*Primary Examiner* — Sebastiano Passaniti
(74) *Attorney, Agent, or Firm* — Smith, Gambrell & Russell, LLP

(57) ABSTRACT

The present invention is directed to an iron-type golf club head with one or more passages travelling through a portion of the body. The passages may be accessible in the toe, heel, rear, or sole, or any combination thereof. The passages may be substantially vertical, substantially horizontal or a combination thereof. Weight inserts may be placed in one or more of the passages. In addition, one or more weight inserts may be coupled to the rear of the club head. The weight inserts may have varying densities. The present invention may also include a removable face insert. A plurality of weight inserts may be attached to the rear surface of the face insert.

15 Claims, 7 Drawing Sheets

GOLF CLUB HEAD HAVING VARIABLE CENTER OF GRAVITY LOCATION

FIELD OF THE INVENTION

The present invention relates to a golf club head that has an adjustable center of gravity. More specifically, the present invention relates to a golf club head that includes interchangeable elements that can be manipulated to vary the center of gravity of the club head.

BACKGROUND OF THE INVENTION

Golf club heads come in many different forms and makes, such as wood- or metal-type, iron type (including wedge-type club heads), utility- or specialty-type, and putter-type. Each of these styles has a prescribed function and make-up.

For example, iron-type and utility-type golf club heads generally include a front or striking face, a hosel, and a sole. The front face interfaces with and strikes the golf ball, and may include a plurality of grooves, sometimes referred to as "score lines," that assist in imparting spin to the ball. The hosel is generally configured to have a particular look to the golfer, to provide a lodging for the golf shaft, and to provide structural rigidity for the club head. Also included is a sole, which is particularly important to a golf shot because it contacts and interacts with the playing surface during the swing.

In conventional sets of iron-type golf clubs, each club includes a shaft with a club head attached to one end and a grip attached to the other end. The club head includes a face for striking a golf ball. The set generally includes irons that are designated number 3 through number 9, and a pitching wedge. One or more additional long irons, such as those designated number 1 or number 2, and wedges, such as a gap wedge, a sand wedge, and a lob wedge, may optionally be included with the set. Alternatively, the set may include irons that are designated number 4 through number 9, a pitching wedge, and a gap wedge.

In golf parlance, the angle between the face and a vertical plane is called the loft angle. Each iron typically has a shaft length that usually decreases through the set as the loft for each club head increases from the long irons to the short irons. Specifically, irons with lower numbers have longer shaft lengths and smaller loft angles. In addition, the overall weight of each club head increases through the set as the shaft length decreases from the long irons to the short irons. To properly ensure that each club has a similar feel or balance during a golf swing, a measurement known as "swingweight" is often used as a criterion to define the club head weight and the shaft length. Because each of the clubs within the set is typically designed to have the same swingweight value for each different lofted club head or given shaft length, the weight of the club head is confined to a particular range.

The length of the shaft, along with the club head loft, moment of inertia, and center of gravity location, impart various performance characteristics to the ball's launch conditions upon impact and dictate the golf ball's launch angle, spin rate, flight trajectory, and the distance the ball will travel. Flight distance generally increases with a decrease in loft angle and an increase in club length. However, difficulty of use also increases with a decrease in loft angle and an increase in club length.

Iron-type golf clubs generally can be divided into three categories: blades and muscle backs, conventional cavity backs, and modern multi-material cavity backs. Blades are traditional clubs with a substantially uniform appearance from the sole to the top line, although there may be some tapering from sole to top line. Similarly, muscle backs are substantially uniform, but have extra material on the back thereof in the form of a rib that can be used to lower the club head center of gravity. A club head with a lower center of gravity than the ball center of gravity facilitates getting the golf ball airborne. Because blade and muscle back designs have a small sweet spot, which is a term that refers to the area of the face that results in a desirable golf shot upon striking a golf ball, these designs are relatively difficult to wield and are typically only used by skilled golfers. However, these designs allow the skilled golfer to work the ball and shape the golf shot as desired.

Cavity backs move some of the club mass to the perimeter of the club by providing a hollow or cavity in the back of the club, opposite the striking face. The perimeter weighting created by the cavity increases the club's moment of inertia, which is a measurement of the club's resistance to torque, for example the torque resulting from an off-center hit. This produces a more forgiving club with a larger sweet spot, which in turn increases the ease of use. The decrease in club head mass resulting from the cavity also allows the size of the club face to be increased, further enlarging the sweet spot. Accordingly, these clubs are easier to hit than blades and muscle backs, and are therefore more readily usable by less-skilled and beginner golfers.

Modern multi-material cavity backs are the latest attempt by golf club designers to make cavity backs more forgiving and easier to hit. Some of these designs replace certain areas of the club head, such as the striking face or sole, with a second material that can be either heavier or lighter than the first material. These designs can also contain undercuts, which stem from the rear cavity, or secondary cavities. By incorporating materials of varying densities or providing cavities and undercuts, mass can be freed up to increase the overall size of the club head, expand the sweet spot, enhance the moment of inertia, and/or optimize the club head center of gravity location.

Traditionally, golf club heads are manufactured to have a certain center of gravity that is not adjustable. However, each individual's swing is as unique as the individual, which results in the fact that one club design will not fit all or even most of today's golfers. For example, a golfer who normally picks the ball clean from the hitting surface would likely prefer a club head with a lower center of gravity allowing for a higher trajectory than a traditional club. On the other hand, a golfer that hits down and through the turf taking a divot would likely prefer a higher center of gravity that allows for a lower trajectory than a traditional club.

In addition, a golfer's swing is likely to vary from day to day based on course conditions, fatigue, and numerous other factors. Due to fatigue, a golfer who normally picks the ball clean may find that he is hitting down on the ball and taking a divot. Further, all golf courses are not identical. For example, on certain courses such as Scottish links, the turf on the fairways is extremely tight and firm. Players are unable to swing down and through the turf, forcing them to sweep or pick the ball clean. In contrast, when windy conditions prevail it is beneficial to have a high center of gravity on the club to keep the ball on a lower trajectory that is less likely to be affected by the wind. Alternatively, on a course with hard, fast greens a golfer is more likely to prefer a lower center of gravity resulting in a higher trajectory and a greater chance of keeping the ball on the green.

BRIEF DESCRIPTION OF THE DRAWINGS

Further features and advantages of the invention can be ascertained from the following detailed description that is provided in connection with the drawings described below.

SUMMARY OF THE INVENTION

Figure 1:
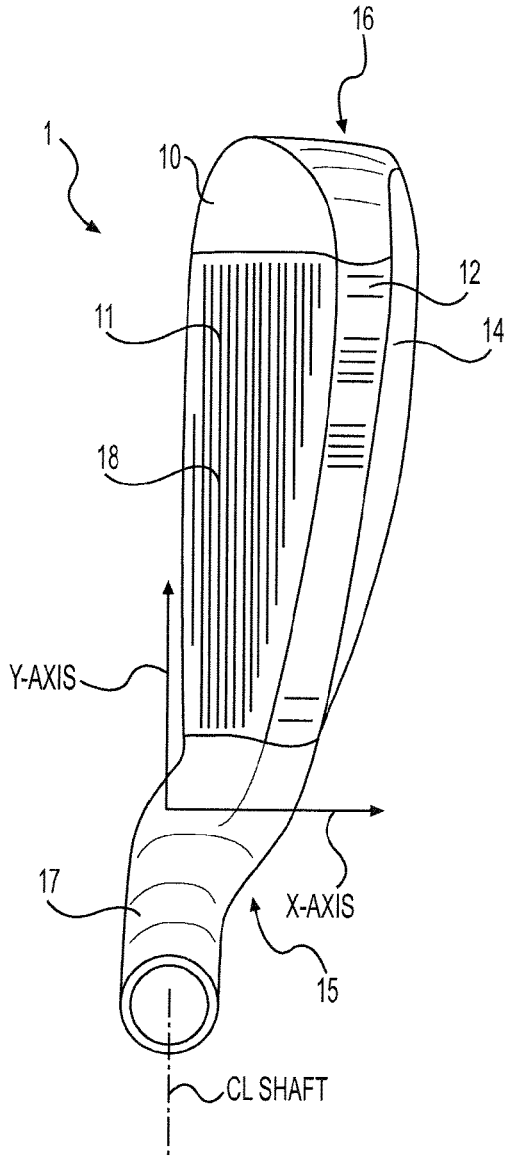
FIG. 1 is diagram showing a top view of a golf club head according to one aspect of the present invention.

The present invention is directed to an iron-type golf club head, comprising a body defining a striking face, a top line, a sole, a back, a heel, a toe, and a hosel. In addition, there may be at least one passage travelling through a portion of the body. The passages may be accessible in the toe, heel, rear, or sole, or any combination thereof.

The passages may travel substantially horizontal over a length of about 25% to about 90% of the distance from the toe to the heel. In another embodiment, the passages may be substantially vertical over a portion of the club head, and travel about 25% to about 90% of the distance from the sole to the top line.

A removable weighted insert may be inserted into one or more of the passages. Alternatively, the weighted insert may be coupled to the rear of the club head. The weighted insert may be comprised of one or more materials with each material having a different density. For example, the weighted insert may be comprised of a first portion with a first density and a second portion with a second density. The first density may be greater than the second density. In one embodiment, the first density may be greater than the second density about 1 g/cm$^3$. In another embodiment, the first density may be greater than the second density by about 5 g/cm$^3$. The first density may be greater than the second density by about 10 g/cm$^3$.

In another embodiment, the golf club may have a removable face insert. The removable face insert may have openings on the rear surface. In one embodiment, removable weight inserts may be secured with in the openings on the rear surface of the face insert. The weight inserts may vary in density. For example, the density of a first weighted insert is greater than the density of a second weighted insert by at least 1 g/cm$^3$. In another embodiment, the density of a first weighted insert is greater than the density of a second weighted insert by at least 5 g/cm$^3$. In another embodiment, the density of a first weighted insert is greater than the density of a second weighted insert by at least 10 g/cm$^3$.

DETAILED DESCRIPTION OF THE PREFERRED EMBODIMENTS

The present invention generally relates to a golf club head that has a variable center of gravity. One manner in which this may be accomplished is by manipulating the position of weight members that are positioned within the interior volume of the club or on the external surface of the club. In some embodiments, the manipulation of the center of gravity may be performed by a golfer as desired. In other aspects, however, the center of gravity may be manipulated and fixed by the golf club manufacturer. For instance, the center of gravity may be manipulated to move between the head and toe or at a selected distance from the face.

According to one aspect, the present invention may be used with any type of club known to those skilled in the art, including irons, wedges, woods, putters, drivers, and the like. The golf club head may include a face, skirt, crown, sole, and hosel. The face preferably includes score lines, or grooves, that aid in imparting spin to a golf ball during impact. In addition, other elements may be operatively combined with the club head, or they may be separate bodies, such as inserts, coupled thereto. Although the club head is described herein with respect to an iron, it will be understood that the present invention is applicable to any type of club known to those skilled in the art.

Figure 2:
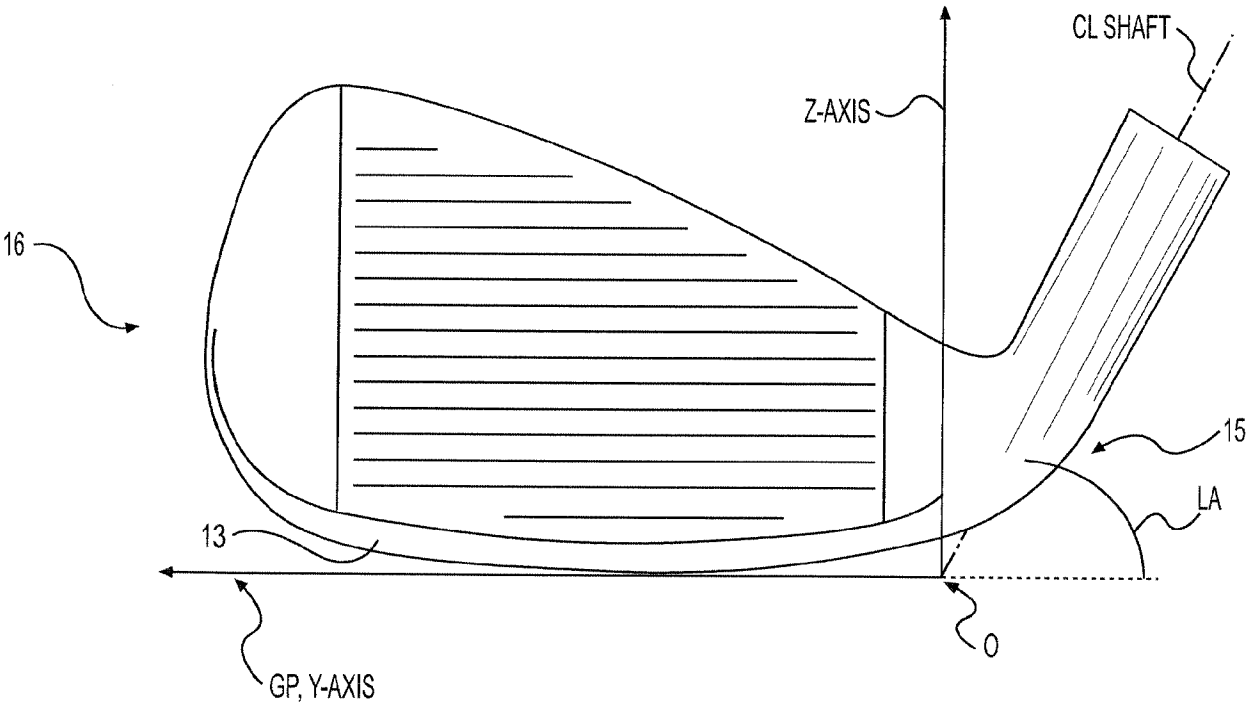
FIG. 2 is a diagram showing a front view of the golf club head shown in FIG. 1.

FIG. 1 is a top view of a iron-type golf club head 1 of the present invention and FIG. 2 is a front view of the golf club head 1. The golf club head 1 includes a body 10 defining a front surface 11, a top line 12, a sole 13, a back 14, a heel 15, a toe 16, and a hosel 17. The striking face of the front surface 11, which preferably contains grooves 18 therein, and the sole 13 may be unitary with the body 10, or they may be separate bodies, such as inserts, coupled thereto. While the club head 1 is illustrated as an iron-type golf club head, as briefly discussed above, the present invention may also pertain to a utility-type golf club head or a putter-type club head.

FIGS. 1 and 2 define a convenient coordinate system to assist in understanding the orientation of the golf club head 1 and other terms discussed herein. An origin O is located at the intersection of the shaft centerline $CL_{SH}$ and the ground plane GP, which is defined at a predetermined angle from the shaft centerline $CL_{SH}$, referred to as the lie angle LA, and tangent to the sole 13 at its lowest point. An X-axis is defined as a vector that is opposite in direction of the vector that is normal to the face 11 projected onto the ground plane GP. A Y-axis is defined as the vector perpendicular to the X-axis and directed toward the toe 16. A Z-axis is defined as the cross product of the X-axis and the Y-axis.

As known to those of ordinary skill in the art, MOI is a measure of the resistance of a body to angular acceleration about a given axis, and is equal to the sum of the products of each element of mass in the body and the square of the element's distance from the axis. Thus, as the distance from the axis increases, the MOI increases, making the club more forgiving for off-center hits since less energy is lost during impact from club head twisting. Thus, moving or rearranging mass to the club head perimeter enlarges the sweet spot and produces a more forgiving club. Moving as much mass as possible to the extreme outermost areas of the club head 1, such as the heel 15, the toe 16, or the sole 13, maximizes the opportunity to enlarge the sweet spot or produce a greater MOI.

In embodiments where the club head comprises an iron, various properties of the club head may be changed as desired. For instance, the club head weight, size, and moment of inertia (MOI) may optionally be varied. According to one aspect, for example, the club head preferably has a volume between about 100 and about 600 cubic centimeters (cc). More preferably, the club head has a volume between about 200 and about 500 cc. Most preferably, the club head has a volume between about 300 and about 475 cc.

The club head may also be manipulated by varying the MOI. A first way to describe the MOI is by the MOI from heel to toe. Preferably, the MOI from heel to toe is about 3000 g-cm$^2$ or greater. More preferably, the MOI from heel to toe is about 4000 g-cm$^2$ or greater. Most preferably, the MOI from heel to toe is about 5000 g-cm$^2$ or greater. In another aspect, the MOI from heel to toe is preferably between about 1000 g-cm$^2$ and about 8000 g-cm$^2$. More preferably, the MOI from heel to toe is between about 3000 g-cm$^2$ and about 8000 g-cm$^2$. Most preferably, the MOI from heel to toe is between about 5000 g-cm$^2$ and about 8000 g-cm$^2$.

A second way to describe the MOI is by the MOI from top to bottom. Preferably, the MOI from top to bottom is about 2000 g-cm$^2$ or greater. More preferably, the MOI from top to bottom is about 3000 g-cm$^2$ or greater. Most preferably, the MOI from top to bottom is about 4000 g-cm$^2$ or greater. In another embodiment, the MOI from top to bottom is preferably between about 500 g-cm$^2$ and about 7000 g-cm$^2$. More preferably, the MOI from top to bottom is between about 2000 g-cm$^2$ and about 7000 g-cm$^2$. Most preferably, the MOI from top to bottom is between about 3000 g-cm$^2$ and about 7000 g-cm$^2$.

The total weight of the club head may also be varied, and may depend on the type of club used. For instance, in one embodiment the total weight of the club head is preferably between about 190 grams (g) and about 210 g. More preferably, the total weight of the club head is between about 195 and about 205 g. Most preferably, the total weight of the club head is between about 197 g and about 200 g. Alternately, the total weight of the club head is preferably about 190 g or greater. More preferably, the total weight of the club head is about 200 g or greater. Most preferably, the total weight of the club head is about 220 g or greater.

In another aspect, the total weight of the club head is preferably between about 200 g and about 220 g. More preferably, the total weight of the club head is between about 205 g and about 215 g. Most preferably, the total weight of the club head is between about 207 g and about 210 g. Those skilled in the art will understand that the desired weight of the club head may be selected based on the type of club used, e.g., a driver, fairway, iron, and the like.

It is desirable for the club to include any type of material known to those skilled in the art. Examples of materials that may be used include, but are not limited to, metals, composites, rubber, glass, plastic, and alloys. In particular, some parts of the club head may be formed of a metallic material such as stainless steel, aluminum, or titanium. These materials may be chosen such that they can withstand the stresses and strains incurred during a golf swing, including those generated through striking a golf ball or the ground. Preferably, the club head is engineered to create a primary load bearing structure that can repeatedly withstand such forces.

Other portions of the club head, such as the top line, experience a reduced level of stress and strain and may be replaced with a lighter, weight-efficient secondary material. Lighter weight materials, such as low density metal alloys, plastic, composite, and the like, which have a lower density than or equivalent density to the previously mentioned metallic materials, can be used in these areas, allowing the club head designer to redistribute the "saved" weight or mass to other, more beneficial locations of the club head. Other properties of these portions of the club head may also be manipulated, e.g., by making them thinner to enhance the weight savings.

For instance, the face and sole of the club head may be formed from a metal, such as 8-11 castable Titanium (Ti) or 3-2 Ti. To achieve weight savings, the top line may be manufactured from a composite. Alternately, the face does not have to be completely metal. Instead, the face may include a matrix of composites and metals.

As mentioned above, it is desirable for the present invention to be used with any type of club known to those skilled in the art. The club heads used may have a variety of different characteristics. One example of a characteristic that may be varied is the hosel of the club head. Many different types of hosels are known to those skilled in the art, including single hosels, two piece hosels, multiple piece hosels, hosels with insulating material, and the like, any of which may be used. Additionally, the present invention may be used in combination with any type of club shaft, having any desired properties known to those skilled in the art.

Figure 3:
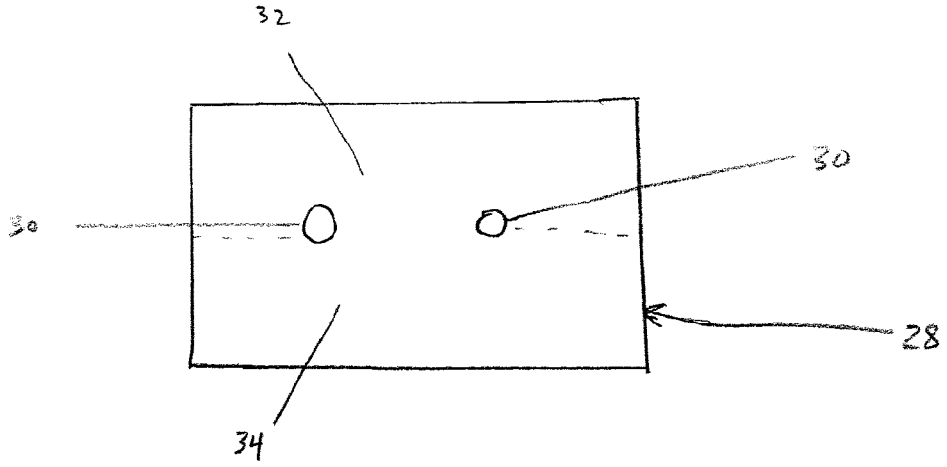
FIG. 3 is a rear view of a mass insert of the present invention.

According to one aspect, the present invention includes a mass that may be attached to the club head. It may be desirable for the mass to comprise an uneven weight distribution. The mass may comprise any shape desired by those skilled in the art. For instance, the mass 28 may be rectangular, as shown in FIG. 3 of the present invention. In alternate embodiments, the mass 28 may be triangular, circular, or asymmetrically shaped. Depending on the shape of the mass 28, the weight distribution may be varied from top to bottom, left to right, front to back, or any combination thereof.

The mass 28 may include one or more materials, each of which may have different properties. Generally, the mass 28 may be formed from two different materials, each of which has a different density. One embodiment may include a mass 28 that includes at least one material having a high density and one material having a low density. The distribution of the high density material and the low density material may be varied as desired by those skilled in the art. For example, a material with a high density may be used in one or more "heavy" portions, and a material with a low density may be used in one or more "light" portions. The heavy portions may be formed from a material with a density greater than about 7 g/cm$^3$. In one embodiment, the heavy portions are formed from a material with a density greater than about 10 g/cm$^3$. In another embodiment, the heavy portion is composed of a material with a density that is greater than about 15 g/cm$^3$. In addition, the heavy portion may have a density that is greater than the light portion(s) by at least about 1 g/cm$^3$. In another embodiment, the heavy portion has a density that is greater than the light portion by about 5 g/cm$^3$. Alternatively, the material of the heavy portion may have a density that is greater than the material of the light portion by about 10 g/cm$^3$.

In other embodiments, the mass 28 may include only one material. Because one advantage of including the mass 28 in the head of the golf club is to manipulate weight distribution, the weight distribution of the mass 28 may unevenly distributed, e.g., not be uniform. This may be accomplished in a variety of manners, such as by increasing the thickness of the mass 28 in different areas.

The mass 28, according to one embodiment, may be divided into two or more sections. To achieve the variable weight distribution, each section may be weighted differently than other sections. For example, in the embodiment shown in FIG. 3, the rectangular mass is preferably divided into at least two sections 32 and 34. The dimensions of each section may be varied, and may be similar or different. One example is shown in the FIG. 3 embodiment, where section 32 is larger than section 34. Preferably, section 34 is heavier than section 32. Again, this may be accomplished by either using a material with a higher density for section 34, or by increasing the dimensions, e.g., thickness of section 34.

Figure 4:
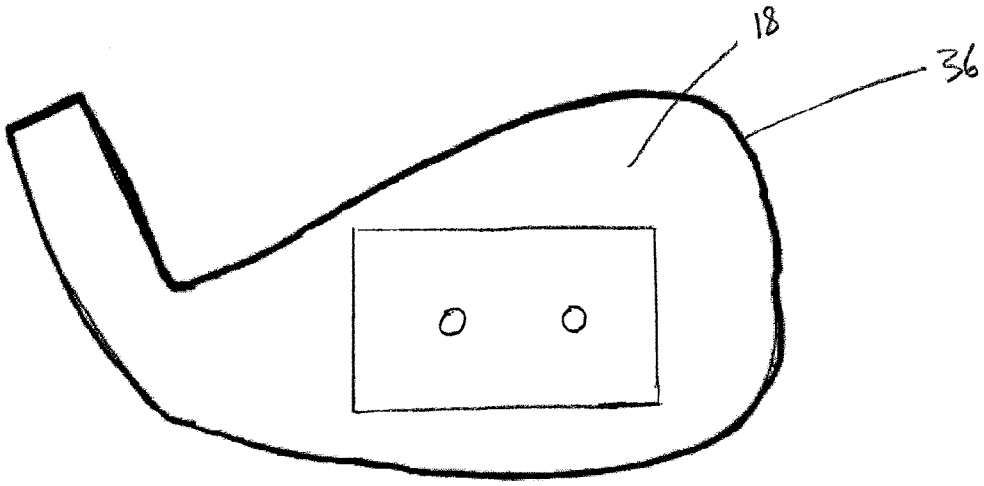
FIG. 4 is a rear view of a golf club head of the present invention.

In one aspect, the mass 28 is attached to part of the club head 36, shown in FIG. 4. Any known means for attaching the mass 28 to the club head 36 may be used. For instance, a fastener, such as a mechanical fastener, may be desirable. However, any fastener may be used including, but not limited to, a screw, bolt, nail, or other mechanical fastener. For instance, in one embodiment the mass 28 includes one or more openings that allow it to be attached to a surface of the golf club using a fastener. In particular, in the FIG. 3 embodiment the mass 28 includes two openings 30, through which a fastener may pass, that allow it to be attached to the back 18 of the golf club, as shown in FIG. 4. The surface of the golf club may include a recess, through which the fastener may pass, in order to secure the mass 28 to the golf club head 36.

Optionally, the surface of the golf club may include a recess that corresponds to the dimensions, e.g., size, shape, depth, of the mass 28 that provides a socket into which the mass 28 may be inserted. The recess is preferably configured and dimensioned such that it provides additional surface area for the mass 28 to come into contact with the surface of the club head. In other words, a surface of the mass 28 will come into contact with the surface of the club, and the edges of the mass 28 may also contact the edges of the recess. In this manner, the increased contact surface area aids in securing the mass 28 to the club head.

Skilled artisans will recognize that any other desired method or apparatus of securing the mass 28 to the club head may be used. For instance, an adhesive, such as epoxy, resin, cement, or glue may be used to fasten the mass 28 to the club head. Other forms of attachment, such as an interference fit or a "lock and key" system, both of which are well known to those skilled in the art, may be used as desired. Further, two or more types of fasteners may be used in combination, e.g., a screw and an adhesive.

Depending on a particular application, either the vertical or horizontal center of gravity may be manipulated as desired. In the FIG. 3 embodiment, for example, the mass 28 may be used to vary the vertical center of gravity of the club head 36. In other words, if the light part 32 of the mass 28 is up and the heavy part 34 is down, the center of gravity may be manipulated downwards. Conversely, if the heavy part 34 is up and the light part 32 is down, the center of gravity may be manipulated upwards.

Of course, skilled artisans will recognize that the FIG. 3 embodiment is just one example of a mass that may be used to manipulate the center of gravity of the club head. In other embodiments, the more than one mass may be used, or the weight distribution of the one or more masses may be varied as desired. For instance, in another aspect the mass may have a weight distribution that is varied from top to bottom, and from front to back. In this manner, both the vertical and horizontal centers of gravity may be manipulated using the mass.

Figure 5:
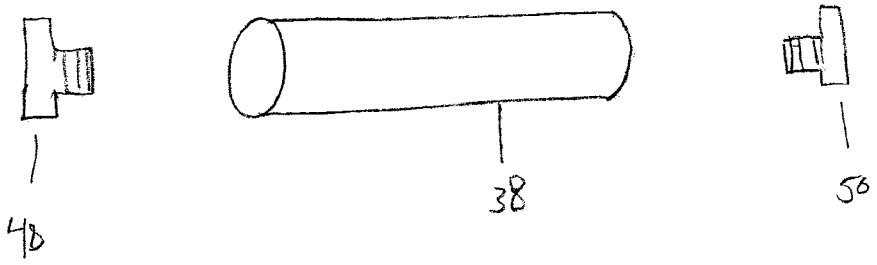
FIG. 5 is a rear view of the weighted insert of the present invention.

According to another aspect, the present invention uses a smaller insert, such as a weight bar, in order to manipulate the center of gravity of a golf club head. An example of a weight bar that may be used in combination with the present invention is shown in FIG. 5. In this embodiment, the weight bar 38 is preferably cylindrical, although any other shape, e.g., square, circular, pentagonal, hexagonal, or the like may be used as desired.

In some embodiments, the weight distribution of the weight bar 38 is preferably uniform, although in other embodiments the weight distribution may be unevenly distributed, as discussed with respect to the embodiments shown in FIGS. 3 and 4. For example, the density of a portion of the weight bar 38 may be greater than the density of another portion of weight bar 38. In this manner the center of gravity may be biased toward the heel or the toe of the club depending upon the orientation of the greater density portion. A material with a high density may be used in one or more "heavy" portions, and a material with a low density may be used in one or more "light" portions. The heavy portions may be formed from a material with a density greater than about 7 g/cm$^3$. In one embodiment, the heavy portions are formed from a material with a density greater than about 10 g/cm$^3$. In another embodiment, the heavy portion is composed of a material with a density that is greater than about 15 g/cm$^3$. In addition, the heavy portion may have a density that is greater than the light portion(s) by at least about 1 g/cm$^3$. In another embodiment, the heavy portion has a density that is greater than the light portion by about 5 g/cm$^3$. Alternatively, the material of the heavy portion may have a density that is greater than the material of the light portion by about 10 g/cm$^3$.

Figure 6:
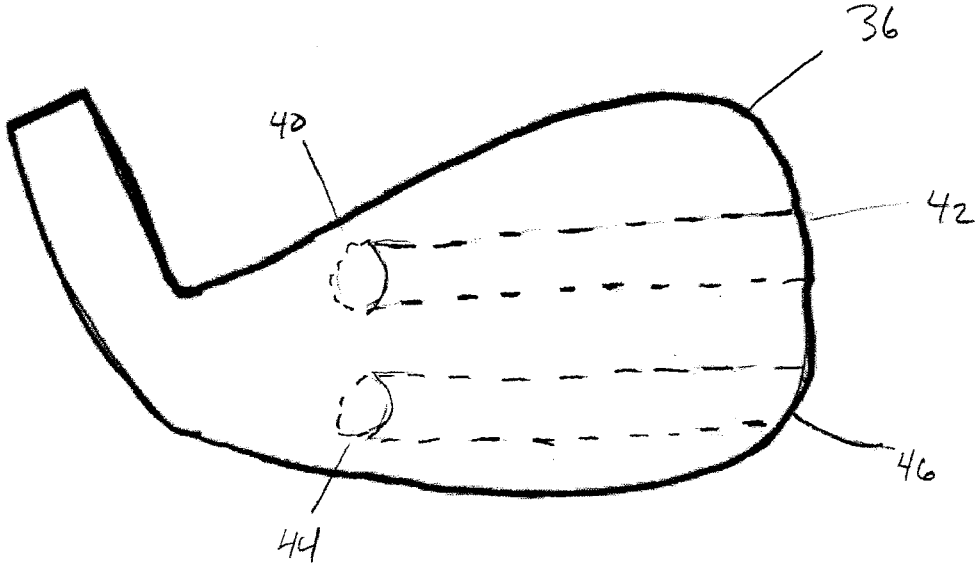
FIG. 6 is a rear view of a golf club head of the present invention.

The weight bar 38 may be inserted into or attached to the golf club head 36, shown in FIG. 6, in any desired manner. For example, in one aspect the golf club head 36 is configured and dimensioned with at least one passage. The passage includes at least one opening, and preferably two openings 40, 42 that allow the weight bar 38 to be inserted. It is desirable for the passage to be configured and dimensioned such that the weight bar 38 is operable to pass into and rest inside the passage. For aesthetic as well as acoustic purposes, the passage and the weight bar 38 are configured such that the weight bar 38 fits securely within the passage. One advantage of achieving a secure fit is that the movement of the weight bar 38 within the passage will be minimized, preventing it from making noises or rattling when it is positioned properly.

Figure 7:
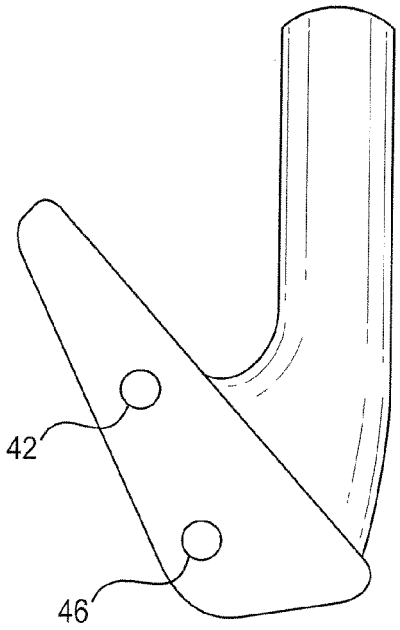
FIG. 7 is a heel side view of a golf club head of the present invention.

The passage is preferably formed such that its openings 40, 42 are generally located near the heel and near the toe of the club head 36. For example, FIG. 7 is a toe side view of an embodiment of the present invention. As shown in FIG. 7, openings 42 and 46 are accessible at the toe end of the club head.

The passage is substantially horizontal passing from the heel to the toe of the club. The length of the passage may be from about 25% to about 90% of the distance from the toe to the heel. In one embodiment, the length of the passage is from about 50% to about 75% of the distance from the toe to the heel. In another embodiment, the length of the passage is greater than about 50% of the distance from the toe to the heel of the club. In another embodiment, the passage is accessible from one opening located either on the toe side or the heel side of the club head. Forming the passages in this manner allows the weight bar 38 to manipulate the center of gravity upwards or downwards, as well as in the heel toe direction depending upon the density distribution of the bar. In alternate embodiments, the passage may be formed such that it passes in any direction, e.g., at an angle or the like.

As shown in FIG. 6, one embodiment of the present invention may also include more than one passage, each of which can accommodate a weight bar. Preferably, the golf club head 36 includes at least two passages, accessible through openings 40, 42, and 44, 46 respectively. In embodiments that include two passages, one of the passages may be left empty and a weight bar 38 is preferably inserted into the other passage. One advantage of leaving one of the passages empty is that the center of gravity may be manipulated upwards or downwards. In one embodiment, the passages are substantially the same length. In the alternative, the passages are of unequal length. For example, the top passage may be smaller in length than the bottom passage.

When, for example, the weight bar 38 is inserted into the bottom passage and the top passage is left empty, the center of gravity of the golf club head 36 may be moved downwards. On the other hand, the center of gravity is moved upwards when the bottom passage is left empty and the weight bar 38 is inserted into the top passage. In alternate embodiments, more than one weight bar 38 may be used at a time. The weight bars may have similar or different properties, e.g., weight, materials, weight distribution, density, which may aid in distributing the center of gravity of the club head 36.

The one or more weight bars 38 may be secured inside the passages using any desired method or apparatus known to those skilled in the art. In one embodiment, for example, screws 48 and 50 may be used to secure the weight bar 38. The screws 48 and 50 preferably include male threads that correspond to female threads on the inner surface of the openings. After the screws have been positioned as desired, they may be prevented from backing out by placing an adhesive or other finishing layer over their surface, if desirable.

Figure 8:
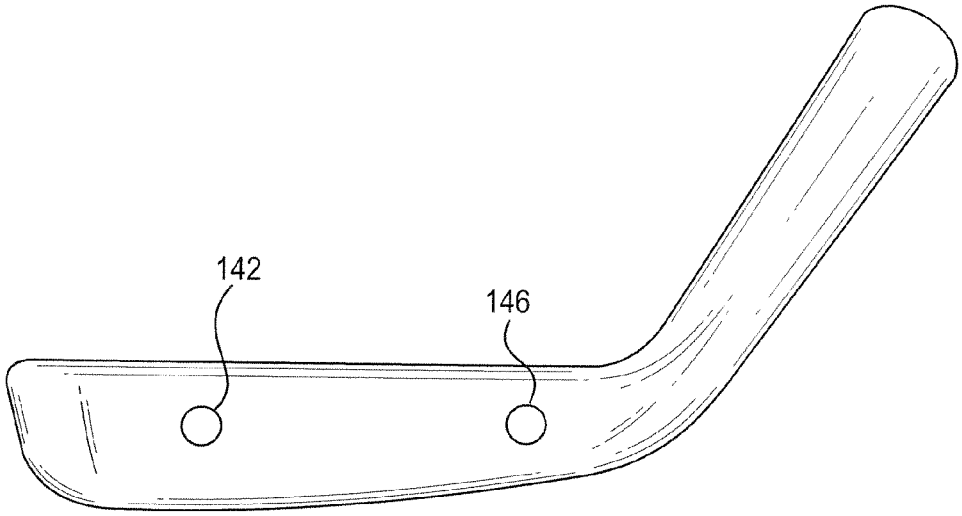
FIG. 8 is a toe side view of a golf club head of the present invention.
Figure 9:
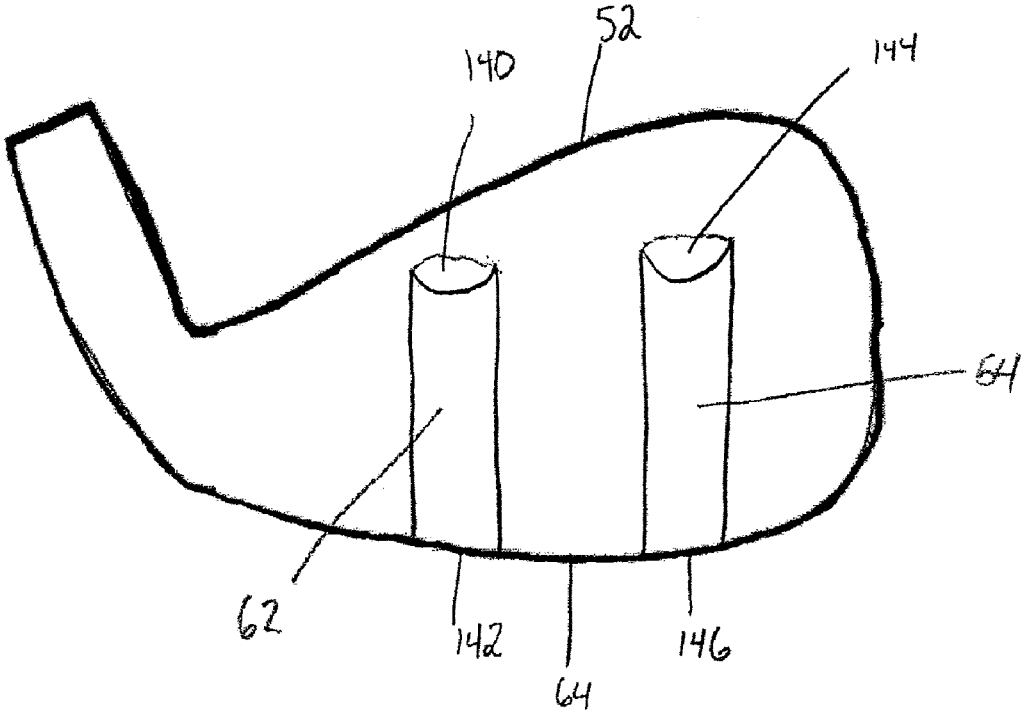
FIG. 9 is a rear view of a golf club head of the present invention.

In an alternate embodiment, the one or more passages 62, 64 may be positioned such that their openings 140, 142, 144 and 146 are generally positioned near the top line 52 or sole 54 of the club head 36, as shown in FIG. 9. Alternatively, as shown in FIG. 8, the passages 62 and 64 may only be accessible from the sole 54 of the club head. In addition, the length of the passage may be from about 25% to about 90% of the distance from the sole 64 to the top line 52. In one embodiment, the length of the passage is from about 50% to about 75% of the distance from the sole 64 to the top line 52. In another embodiment, the length of the passage is greater than about 50% of the distance from the sole 64 to the top line 52. In one embodiment, the passages are substantially the same length. In the alternative, the passages may be of unequal length.

Figure 10:
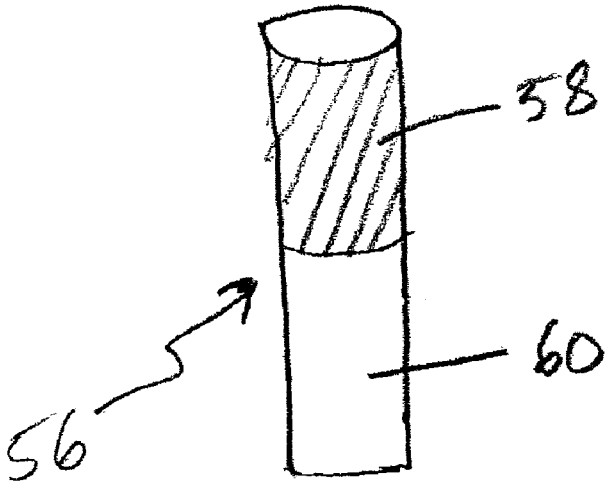
FIG. 10 is a rear view of the weighted insert of the present invention.

In one embodiment, the weight bar 56, shown in FIG. 10, may include an uneven weight distribution. As one example, the weight bar 56 may generally be divided into two sections 58 and 60. The dimensions, e.g., size of each section 58 and 60 may be different, although in some embodiments they may be the same.

As discussed with respect to the FIGS. 5 and 6 embodiments, the materials used to form the two sections 58 and 60 may be the same or different, and the weight distribution of the two sections 58 and 60 may not be uniform. In embodiments where the distribution of the weight in the weight bar 56 is not uniform, the weight rods may be inserted into a passage with the heavy side up, e.g., closer to the top line or crown, or down, e.g., closer to the sole. When the heavy side of the weight bar is facing upwards, skilled artisans will recognize that the center of gravity of the club head will be moved towards the crown and/or top line. Conversely, when the heavy side of the weight bar is facing downwards, skilled artisans will recognize that the center of gravity of the club head will be moved towards the sole.

Any number of weight bars and corresponding passages may be used as desired. In some embodiments, there may be more passages present than weight bars, i.e., some passages may be empty. In other embodiments, each passage may have a weight bar inserted therein. If, for example, a golf club head includes two passages, as shown in FIG. 9, a weight bar 56 may be placed in the first passage 62 or the second passage 64. Placing a weight bar 56 in the first passage 62 and leaving the second passage 64 empty would move the center of gravity towards the heel of the club head 36, whereas placing a weight bar 56 in the second passage 64 and leaving the first passage 62 empty would move the center of gravity towards the toe of the club head 36.

The vertical center of gravity may be manipulated at the same time as the horizontal center of gravity using the FIG. 9 embodiment described above. For instance, when the weight bar 56 is positioned in passage 62 and the heavier side is facing upwards (near opening 140), the vertical center of gravity is moved upwards at the same time that the horizontal center of gravity is moved towards the heel of the club head 36. If the weight bar 56 is positioned in passage 64 and the heavier side is facing upwards (near opening 144), the vertical center of gravity is moved upwards at the same time that the horizontal center of gravity is moved towards the toe of the club head 36.

The embodiment described above regarding manipulation of the vertical and horizontal center of gravity, discussed with respect to FIG. 9, is just one example. In other aspects, two or more passages may be included, as described above. In this embodiment, weight bars may be positioned in different orientations, e.g., with a heavier side towards the crown or sole, and/or passages may be empty or have weight bars positioned therein as desired. Those skilled in the art will understand that additional weight bars and/or passages will provide the ability to provide further manipulation of the vertical and horizontal center of gravity.

Skilled artisans will understand that combinations of substantially horizontal passages, e.g., as shown in FIG. 6, and substantially vertical passages, e.g., as shown in FIG. 9, may be used in combination as desired. The weight bars and the passages into which they are inserted may have different dimensions and/or properties. As appreciated by those skilled in the art, the passages do not have to be substantially horizontal or vertical. Other passages may be positioned in any desired manner, e.g., diagonally or at an angle.

With regard to the FIGS. 6 and 9 embodiments, any number of passages may be used as desired. Preferably, about one or more passages are included in the club head. Alternatively, about 3 or more passages are included in the club head. In another embodiment, about 6 or more passages are included in the club head. In another aspect, between about 1 and about 10 passages may be included in the club head. More preferably, between about 1 and about 5 passages may be included in the club head. Most preferably, between about 1 and about 3 passages may be included in the club head.

According to another embodiment of the present invention, the center of gravity may be manipulated based on a plurality of inserts that are included in the golf club head. The inserts may have any desired dimensions, such as shape, size, density, materials, or the like. For instance, the inserts may be circular, triangular, rectangular, or the like, and may comprise an elongate form. The size of insert may also vary as desired depending on the configuration and dimensions of the passages.

The inserts may be distributed on any portion of the surface of the golf club head, but are preferably positioned on a surface that does not come into contact with an object, e.g., a golf ball.

One advantage of using the inserts is that they may be distributed to manipulate the center of gravity and/or moment of inertia of the golf club head, as described in more detail below.

Figure 11:
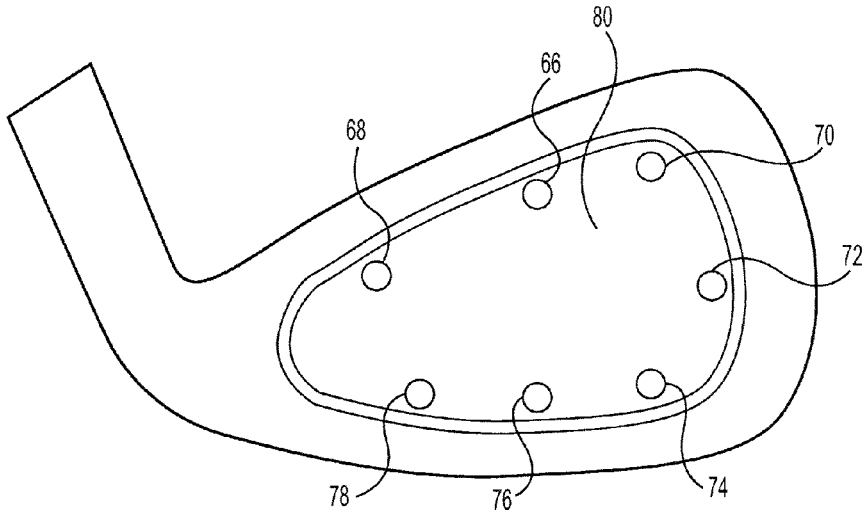
FIG. 11 is a rear view of a golf club head of the present invention.

One example of a golf club head that uses one or more inserts is shown in FIG. 11. As shown in FIG. 11, the golf club head 36 includes a face insert 80. The back of face insert 80, the side that will not come into contact with the ball, has weighted inserts 66-78 that are selectively positioned as desired to manipulate the center of gravity and/or weight distribution. For example, a golfer who wishes to position the center of gravity toward the toe may remove the weighted inserts on the heel and central portions of the club, which correspond to weighted inserts 66, 68, 76, and 78. In another embodiment, the weighted inserts have varied masses. For example, the inserts may be made from materials with a range of densities. A material with a high density may be used in one or more "heavy" inserts, and a material with a low density may be used in one or more "light" inserts. The heavy inserts may be formed from a material with a density greater than about 7 g/cm$^3$. In one embodiment, the heavy inserts are formed from a material with a density greater than about 10 g/cm$^3$. In another embodiment, the heavy inserts are composed of a material with a density that is greater than about 15 g/cm$^3$. In addition, the heavy inserts may have a density that is greater than the light inserts by at least about 1 g/cm$^3$. In another embodiment, the heavy inserts have a density that is greater than the light inserts by about 5 g/cm$^3$. Alternatively, the material of the heavy inserts may have a density that is greater than the material of the light inserts by about 10 g/cm$^3$. In addition, the weighted inserts 66-78 may be removable or permanently fixed to the rear of the face insert. In one embodiment, the inserts 66-78 are preferably removable bolts that are inserted into passages or holes in the golf club head. Any number of passages or bolts may be used as desired.

In another embodiment, the inserts are used to secure a vibration damping material to the rear of the face insert 80. The vibration damping material is preferably a low-density polymer. The vibration damping material may be removable by removing the inserts. As discussed above, the inserts may vary in density. In addition, a portion of one or more of the inserts may be comprised of a vibration damping material.

Notwithstanding that the numerical ranges and parameters setting forth the broad scope of the invention are approximations, the numerical values set forth in the specific examples are reported as precisely as possible. Any numerical value, however, inherently contain certain errors necessarily resulting from the standard deviation found in their respective testing measurements. Furthermore, when numerical ranges of varying scope are set forth herein, it is contemplated that any combination of these values inclusive of the recited values may be used.

The invention described and claimed herein is not to be limited in scope by the specific embodiments herein disclosed, since these embodiments are intended as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims. All patents and patent applications cited in the foregoing text are expressly incorporated herein by reference in their entirety.

We claim:

1. An iron-type golf club head, comprising:

a body defining a striking face, a top line, a sole, a back, a heel, a toe, and a hosel;

a first passage travelling through at least 50 percent of the distance between the top line and the sole;

a second passage travelling through at least 50 percent of the distance between the top line and the sole, wherein the second passage is disposed between the heel and the first passage;

a first weighted insert comprised of at least one material inserted into the first passage and substantially filling the passage;

a second weighted insert comprised of at least one material inserted into the second passage and substantially filling the passage;

wherein at least one of the first and second weighted inserts are removable and accessible from the top line to enable adjustment of the center of gravity horizontally from the toe to the heel; and wherein the first and second weighted inserts are each comprised of a first portion with a first density and a second portion with a second density so that the density of the inserts vary along a longitudinal axis of the inserts to enable adjustment of the center of gravity vertically from the top line to the sole, and wherein the first and second portions are contiguous.

2. The golf club head of claim 1, wherein at least one of the first and second passages are accessible only from the sole of the golf club head.

3. The golf club head of claim 1, wherein the first density is greater than the second density.

4. The golf club head of claim 3, wherein the first density is greater than the second density by about 1 g/cm$^3$.

5. The golf club head of claim 3, wherein the first density is greater than the second density by about 5 g/cm$^3$.

6. The golf club head of claim 3, wherein the first density is greater than the second density by about 10 g/cm$^3$.

7. The golf club head of claim 1, wherein the second passage is substantially the same length as the first passage.

8. The golf club head of claim 1 wherein the first and second passages are different lengths.

9. The golf club head of claim 1, wherein the first and second passages are substantially vertical over a portion of the club head; and the portion comprises about 50 percent to about 75 percent of the distance from the sole to the top line.

10. The golf club head of claim 1, further comprising a third passage with a third removable weighted insert.

11. A golf club head, comprising:

a body defining a striking face, a top line, a sole, a back, a heel, a toe, and a hosel;

at least one passage travelling through at least 50 percent of the distance between the top line and the sole;

a first weighted insert capable of substantially filling the at least one passage, wherein the first weighted insert is removable and accessible from the top line to enable adjustment of the center of gravity horizontally from toe to heel, and wherein the first weighted insert comprises a first portion having a first density contiguous with a second portion having a second density to enable adjustment of the center of gravity vertically from the top line to the sole, wherein the first density is greater than the second density.

12. The golf club head of claim 11, further comprising a second passage travelling through at least a portion of the body.

13. The golf club head of claim 12, further comprising a second weighted insert capable of substantially filling the second passage, wherein the second weighted insert is removable and accessible from at least one of the top line or sole.

14. The golf club head of claim 12, wherein the second passage travels through at least 50 percent of the distance between the top line and the sole.

15. The golf club head of claim 13, wherein the second weighted insert is accessible only from the sole.

* * * * *